US008491220B1

(12) United States Patent
Rees

(10) Patent No.: US 8,491,220 B1
(45) Date of Patent: Jul. 23, 2013

(54) MECHANIZED ASPHALT COMB

(76) Inventor: Michael Rees, Greenville, IL (US)

( * ) Notice: Subject to any disclaimer, the term of this patent is extended or adjusted under 35 U.S.C. 154(b) by 0 days.

(21) Appl. No.: 13/587,485

(22) Filed: Aug. 16, 2012

(51) Int. Cl.
*E01C 23/12* (2006.01)

(52) U.S. Cl.
USPC ..... 404/94; 404/93

(58) Field of Classification Search
USPC ..... 404/90, 93, 94; 56/400.04
See application file for complete search history.

(56) References Cited

U.S. PATENT DOCUMENTS

| | | | | | |
|---|---|---|---|---|---|
| 637,713 | A | * | 11/1899 | de Camp | 404/90 |
| 1,195,387 | A | * | 8/1916 | Moyer | 404/90 |
| 1,254,859 | A | * | 1/1918 | Siemann | 404/90 |
| 3,053,311 | A | * | 9/1962 | Nottage | 126/401 |
| 3,108,426 | A | * | 10/1963 | Rugg | 56/400.01 |
| 3,470,964 | A | * | 10/1969 | Collins et al. | 172/197 |
| 4,492,490 | A | * | 1/1985 | Christine et al. | 404/108 |
| 4,793,733 | A | * | 12/1988 | Chiba et al. | 404/90 |
| 4,967,850 | A | * | 11/1990 | Bargfrede et al. | 172/197 |
| 5,054,278 | A | * | 10/1991 | Thorndike | 56/400.14 |
| 5,387,051 | A | * | 2/1995 | Valente | 404/84.05 |

FOREIGN PATENT DOCUMENTS

| | | | |
|---|---|---|---|
| DE | 41 29 336 | * | 3/1993 |
| DE | 41 29 336 A1 | | 3/1993 |

OTHER PUBLICATIONS

"Asphalt concrete," http://en.wikipedia.org/wiki/Asphalt_concrete, printed on Aug. 9, 2012, 7 pages.
"Backhoe loader," http://en.wikipedia.org/wiki/Backhoe_loader, printed on Aug. 10, 2012, 3 pages.
"Bulldozer," http://en.wikipedia.org/wiki/Bulldozer, printed on Aug. 10, 2012, 6 pages.
"Compact excavator," http://en.wikipedia.org/wiki/Compact_excavator, printed on Aug. 10, 2012, 3 pages.
"Excavator," http://en.wikipedia.org/wiki/Excavator, printed on Aug. 10, 2012, 5 pages.
"Forklift truck," http://en.wikipedia.org/wiki/Forklift, printed on Aug. 10, 2012, 15 pages.
"Grader," http://en.wikipedia.org/wiki/Grader, printed on Aug. 10, 2012, 3 pages.
"Loader (equipment)," http://en.wikipedia.org/wiki/Loader_(equipment), printed on Aug. 10, 2012, 6 pages.
"Rake (tool)," http://en.wikipedia.org/wiki/Rake_(tool), printed on Aug. 10, 2012, 2 pages.
"Skid-steer loader," http://en.wikipedia.org/wiki/Skid-steer_loader, printed on Aug. 10, 2012, 5 pages.
"Tractor," http://en.wikipedia.org/wiki/Tractor, printed on Aug. 10, 2012, 22 pages.

(Continued)

*Primary Examiner* — Gary Hartmann
(74) *Attorney, Agent, or Firm* — Lewis, Rice & Fingersh, L.C.

(57) ABSTRACT

A mechanized asphalt comb device and method of mechanized asphalt raking in which a mechanized asphalt comb comprised of a rake attachment and an arm is attached to an engineering vehicle via a terminating end of the arm. The engineering vehicle can control and manipulate the mechanized asphalt comb into a raised inactive position, a lowered active position, and a plurality of positions between the raised inactive position and the lowered active position. When in the lowered active position, the mechanized asphalt comb applies a fixed downward pressure and depth of penetration to the applied surface.

9 Claims, 8 Drawing Sheets

OTHER PUBLICATIONS

Asphalt Restoration, http://asphaltrestore.com, printed on Aug. 9, 2012, 2 pages.

Asphalt Repair, PLM Industries, Inc., http://www.potholepro.com/asphalt-repair.html, printed on Aug. 9, 2012, 2 pages.

* cited by examiner

MECHANIZED ASPHALT COMB

BACKGROUND OF THE INVENTION

1. Field of the Invention

This disclosure is related to the field of devices for repairing asphalt deterioration. Specifically, this disclosure is related to raking tools utilized in the asphalt infrared repair process for the repair of potholes, raveled areas, utility cuts, and alligator cracks, amongst other instances of asphalt concrete degradation.

2. Description of Related Art

Asphalt concrete plays a huge role in the infrastructure of modern day westernized society. From its presence in roads, parking lots, driveways, airport landing strips and taxiways, asphalt pavement is an integral component in transit infrastructure.

Generally, in the art of asphalt paving, a road, parking lot, driveway or airport landing strip will be paved with an asphalt concrete with certain performance characteristics in terms of surface durability, tire wear, breaking efficiency, and roadway noise for the particular road and the type and degree of traffic the road is expected to bear. However, over time environmental factors and traffic loads can cause asphalt concrete to deteriorate. Often, both environmental factors and traffic loads contribute to asphalt deterioration and degradation. Environmental factors which cause deterioration include heat and cold, the presence of water in the subbase or subgrade soil underlying the pavement, and frost heaves, among other environmental factors. Traffic damage generally results from trucks and buses, and the damage caused is generally proportional to axle load raised by a certain degree. The deterioration and degradation caused by these factors includes, but is not limited to, crocodile cracking, potholes, upheaval, raveling, rutting, shoving, stripping and grade depressions, amongst others.

Irrespective of the causing agent, deterioration in asphalt roadways, parking lots and other surfaces is a major problem. The deterioration can cause damage to cars and vehicles, decrease transit efficiency, and create an unsightly roadway and parking lot infrastructure, among other problems. To avoid these problems, roadways, parking lots and other asphalt surfaces are regularly maintained to prevent and repair the degradation and deterioration of the asphalt surface that occurs over time.

One method commonly used in the art of asphalt paving to repair damage and degradation is known as infrared repair. The infrared repair process is capable of repairing potholes, raveled areas, utility cuts, alligator cracks, bumps and low spots, and drainage problems, along with many of the other deterioration problems commonly associated with asphalt pavement. The infrared process is generally preferred in the art of asphalt repair due to its low cost and ability to create a seamless repair by thermally bonding the edges of the repair area with the existing asphalt.

The infrared process generally takes place as follows. First, an infrared panel is placed over the area of the asphalt surface to be prepared. The panel is maintained over the repair area until the asphalt reaches a workable hot mix temperature, generally around 280°-300° F. The time required to reach this temperature will vary depending on the ambient temperature of the air and the asphalt pavement. The infrared rays which are utilized are desirable for their ability to heat the asphalt pavement without causing burning or oxidation. Once the repair area is heated to the desired working temperature, the repair area is raked to agitate the top of the asphalt as deep as they can, generally 1" to 1.5" of the asphalt, to scarify (i.e., make cuts or scratches in) the remaining asphalt, and to add new surface asphalt to the repair area. After the addition of the new surface asphalt to the repair area, the material is blended together and luted for proper elevation. After the blending and luting, the repair area is compacted with a compacting tool known to those of ordinary skill in the art such as a vibratory compactor, which compacts the edges of the repair area to the existing asphalt surface, thus creating a thermal bond with the existing pavement and eliminating any seams. To complete the process, the area is allowed to cool before it receives any traffic.

Notably, a seamless repair is possible through the infrared process because the entirety of the heated repair area becomes workable again. Stated differently, the heated asphalt and asphaltic cement that holds the rocks together becomes workable again. The new asphalt that is added to the heated area is generally highly concentrated in asphalt cement (the glue that binds the rock particles together) so that it can be redistributed throughout the repair area. When the repair area is compacted, the repaired area is thermally bonded or glued to the older portion of the asphalt pavement, creating a patch that is flush with the original asphalt pavement. Further, this process is significantly better for the environment than simply tearing out the section and replacing it as less new asphalt is needed, and there is less transportation cost for getting the asphalt to and from the worksite.

While the infrared repair process has many benefits over the other processes known to those of ordinary skill in the art for repairing asphalt, including its ability to create a seamless repair, the process as it is currently practiced in the art is latent with inefficiencies generally surrounding the manual raking process. For example, as noted previously, in the infrared process of the prior art once the repair area reaches a desired temperature after the application of infrared heat, the repair area is raked manually by a laborer. An example of an asphalt rake that is commonly used for this process is provided in Prior Art FIG. 1. Thus, in this step of the traditional infrared repair process, a laborer is required to stand over or around the heated asphalt patch and physically rake and move the hot asphalt to remove the top layer and agitate or scarify the remaining hot asphalt in the repair area. Inherently, this process is both labor intensive and time consuming. Often, the laborer must make multiple raked passes to sufficiently agitate and scarify the asphalt. In addition, after the agitation, a laborer needs to physically shovel the new heated asphalt mix into a wheelbarrow, transport it to the repair area, and rake and distribute it into the repair area. Both of these processes are physically exhaustive and extremely labor intensive due to the heat, fumes and the exertion needed to perform both jobs. The problems can be further exacerbated by certain types of asphalt repairs. For example, the infra-red heating can often not penetrate a boundary between two different asphalt lays, for example, as occurs in resurfacing. Thus, it can be necessary to agitate the entirety of the first level, and then work through that already agitated material, or completely remove it, to agitate the second.

Because these processes are labor-intensive jobs that require a great amount of physical strength and stamina, as a day progresses laborers often become fatigued and the quality, depth, and efficiency of their raking becomes compromised. Further, manual raking of the repair area by a laborer with an asphalt rake can be ineffective. Laborers can only apply a finite amount of down pressure on a hand rake. In addition, this pressure can vary across different points in the job and at different points in the day as a laborer becomes more fatigued. This varying amount of pressure applied to the rake generally results in portions of the repair area that are not raked to a required depth, resulting in the reemerging of cracks that will shorten the life of the repair. Generally, deeper raking is desirable and creates a better repair because it results in the removal of additional deep set cracks prior to the time the new asphalt mixture is introduced into the repair area. Thus, deeper raking generally results in a superior repair that will last longer.

Another limitation beyond a given laborer's varying strength throughout the day is the strength of the rake. It is not uncommon for an application of too much downward pressure on the rake to result in the rake breaking, which not only could temporarily comprise the repair but could also be potentially harmful to the worker. Moreover, in the traditional labor intensive infrared process, if a cold spot is encountered in the repair area it cannot be raked. Rather, the patch must be reheated, which requires more time and fuel, or the cold spot can simply be ignored, which often results in an inadequate repair.

Accordingly, there is a need in the art of asphalt repair for a device that will eliminate the inefficiencies and variability in quality inherent to the manual raking components of the infrared repair process.

SUMMARY OF THE INVENTION

Because of these and other problems in the art, described herein, among other things, a mechanized asphalt comb device and method of mechanized asphalt raking that provides a reliable, easy-to-use, and efficient alternative to the traditional manual raking methodologies.

In one embodiment, described herein is a mechanized asphalt comb, the comb comprising: a rake attachment, the rake attachment being comprised of a rake spine and a plurality of teeth distributed along the rake spine in a downward orientation; and an arm, the arm being comprised of two opposing terminating ends, the rake attachment being attached to one of the arm's terminating ends; wherein the asphalt comb is attached to an engineering vehicle via the terminating end of the arm opposite the rake attachment such that the engineering vehicle can control and manipulate the asphalt comb.

In one embodiment of the mechanized asphalt comb, the rake attachment is approximately 6 feet long.

In another embodiment of mechanized asphalt comb, the comb further comprises a dumping container, the dumping container being hingedly attached to the asphalt comb.

In still another embodiment of the mechanized asphalt comb, the comb further comprises a cooling element, the cooling element being attached to the arm in a downward orientation.

In yet another embodiment of the mechanized asphalt comb, the asphalt comb further comprises a heating element, wherein the heating element raises the temperature of the rake attachment to a desired level.

In yet another embodiment of the mechanized asphalt comb the plurality of teeth is removable from the rake spine either together or individually.

Also disclosed herein is a mechanized method for removing and applying asphalt during an asphalt repair, the method comprising the steps of: obtaining a mechanized asphalt comb attached to an engineering vehicle, the asphalt comb comprising: a rake attachment, the rake attachment being comprised of a rake spine and a plurality of teeth distributed along the rake spine in a downward orientation; an arm, the arm being comprised of two opposing terminating ends, the rake attachment being attached to one of the arm's terminating ends; and wherein the asphalt comb is attached to an engineering vehicle via the terminating end of the arm opposite the rake attachment such that the engineering vehicle can control and manipulate the asphalt comb; moving the engineering vehicle to an asphalt repair site; and scarifying the asphalt repair site while the asphalt comb is in the lowered position.

In another embodiment, the mechanized method for removing and applying asphalt during an asphalt repair will further comprise: in said step of obtaining, obtaining a mechanized asphalt comb further comprising: a dumping container, the dumping container being hingedly attached to the asphalt comb; after said step of obtaining, loading asphalt repair material into the dumping container; after said step of scarifying, dumping the asphalt repair material in the dumping container onto the asphalt repair site; and distributing the asphalt repair material.

DESCRIPTION OF THE PREFERRED EMBODIMENT(S)

Figure 1:
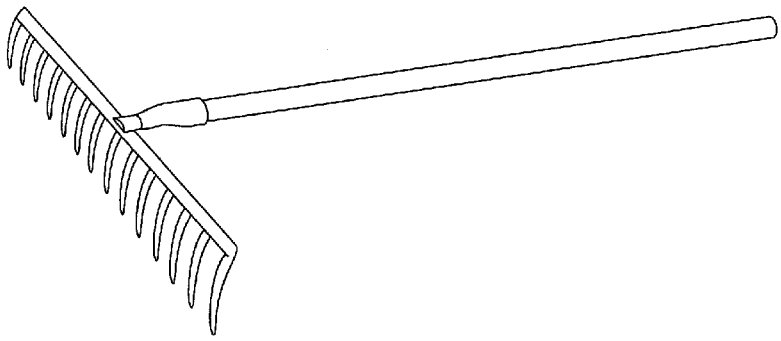
Fig. 1 PRIOR ART
FIG. 1 provides a perspective view of a prior art asphalt rake utilized in the traditional manual raking steps of infrared asphalt repair in the processes of the prior art.
Figure 2:
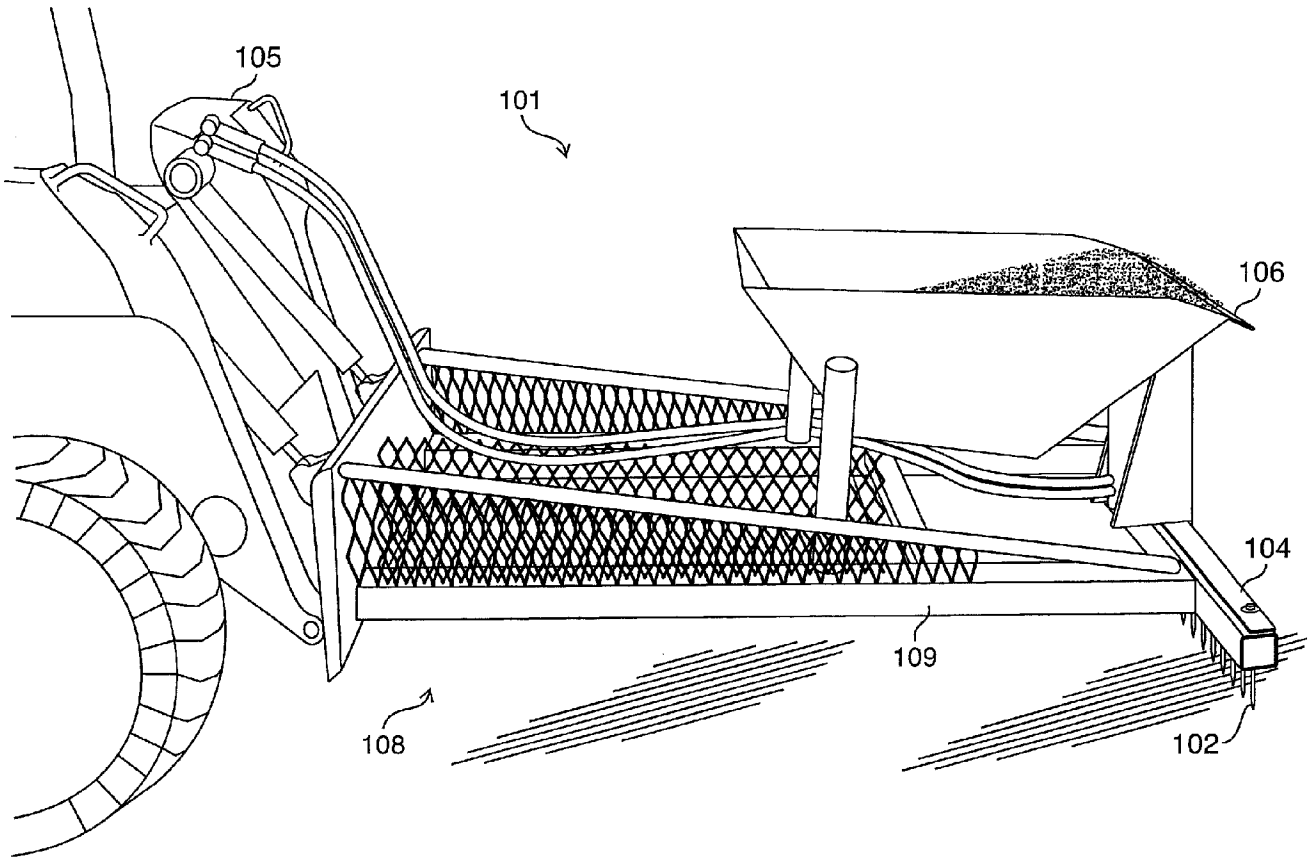
FIG. 2 provides a side perspective view of an embodiment of the asphalt comb in the active down position.
Figure 3:
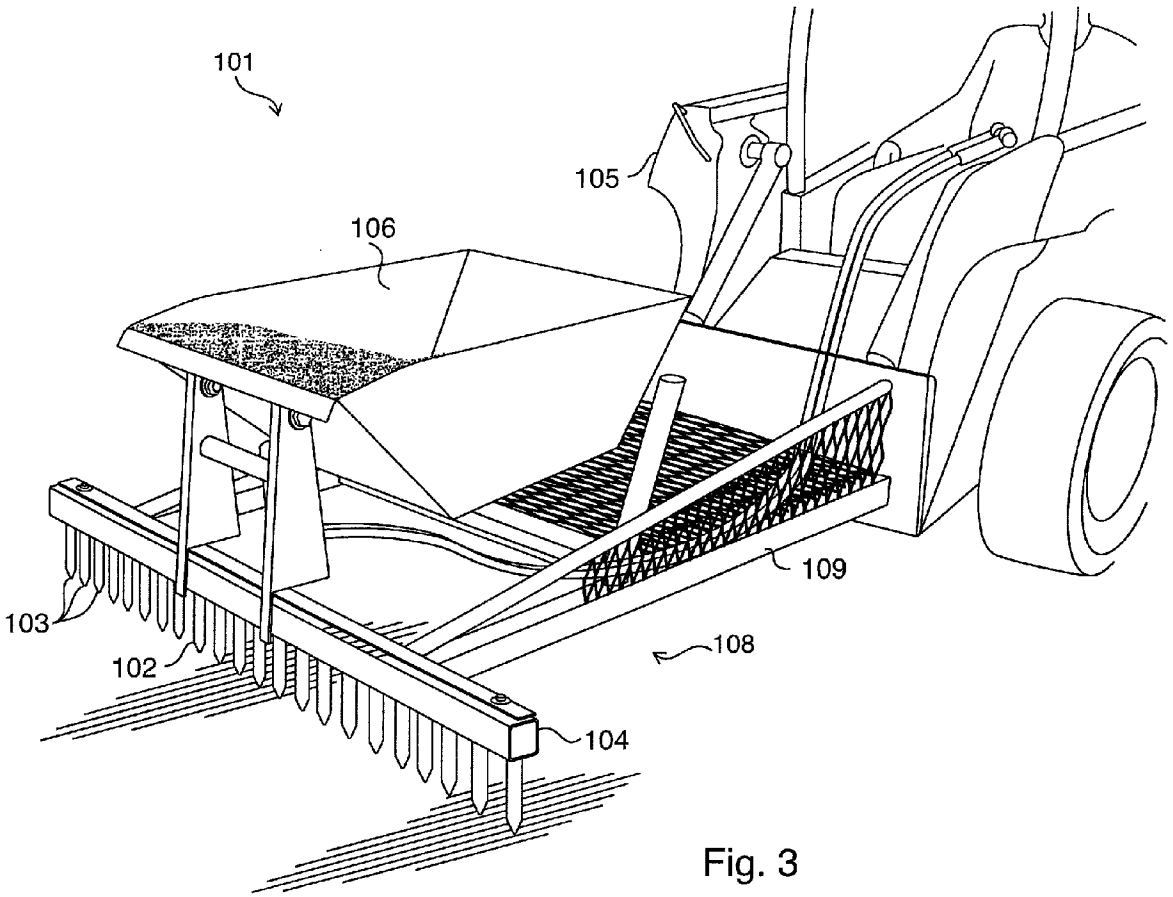
FIG. 3 provides another side perspective view of the asphalt comb in the active down position.
Figure 4:
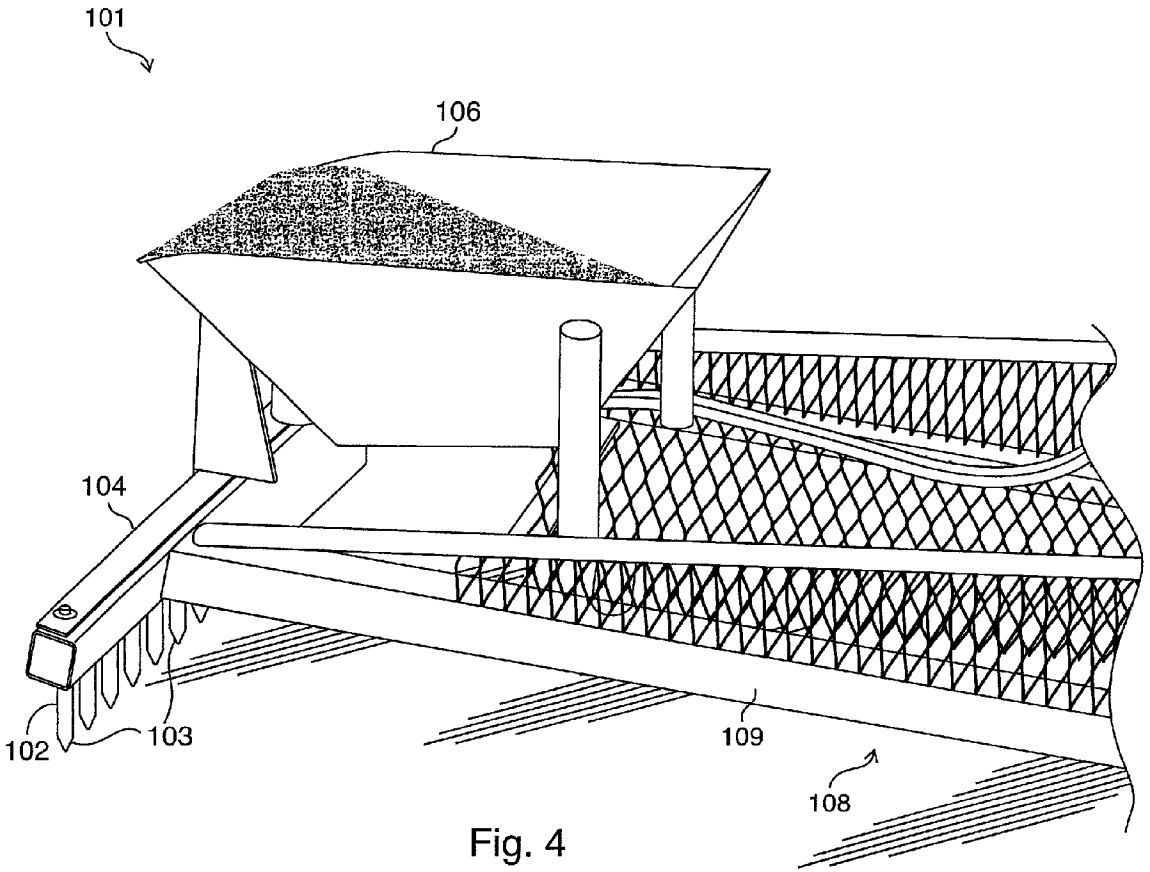
FIG. 4 provides yet another side perspective view of the asphalt comb in the active down position.

FIGS. 2-5 provide various prospective views of an embodiment of the mechanized asphalt comb (101). As seen in FIGS. 2-5, the mechanized asphalt comb (101) is generally comprised of a rake attachment (102). Generally, the rake attachment (102), as most clearly depicted in FIG. 4, will be comprised of a plurality of teeth or tines (103) attached to and dispersed along a horizontally aligned rake spine (104) in a downward orientation. The plurality of teeth or tines (103) on the rake attachment (102) may be space equidistantly from each other, as depicted in FIG. 4, or, in alternative embodiments, may be spaced in a random manner along the rake spine (104). As the term is utilized herein, "rake attachment," shall mean a horizontally aligned rake spine (104) with a plurality of teeth or tines (103) attached thereto in a downward orientation, as depicted in FIG. 4.

The material that comprises the rake attachment (102) is not determinative. Any material known to those of ordinary skill in the art that can withstand the impact of raking and the heat of the asphalt in the infrared repair process is contemplated. Contemplated materials include, but are not limited to, steel, iron, hardened steel, and other heavy duty metals known to those of ordinary skill in the art. In addition, the length and width of the rake attachment (102) is not determinative. Generally any length and width of the rake attachment (102) that allows the attachment (102) to efficiently and effectively rake an asphalt repair area is contemplated. In one embodiment, it is contemplated that the rake attachment's (102) length will correspond to the length of the infrared heating apparatus used to heat the desired repair area often with a corresponding width to allow the entire area to essentially be raked in one pass. For example, in one embodiment, as depicted in FIGS. 2-6, the rake attachment will be approximately six (6) feet in length and around four (4) feet in width.

Further, the length, width and shape of the tines or teeth (103) of the rake attachment (102) are not determinative. Generally any length, width or shape teeth (103) that are capable of effectively raking and scarifying the asphalt repair area are contemplated. In one embodiment, teeth (103) between about 4 inches and 7 inches are contemplated. In one embodiment, the teeth or tines (103) will be proscribed dimensions to maximize the raking of the repair area in order to rake the patch deeper and take out any cold spots in the asphalt to create a more uniform patch. For example, in one preferred embodiment, as depicted in FIGS. 2-6, the teeth will extend approximately 6 inches below the rake spine (104) and are designed to agitate between about 2" to about 4" of depth from the asphalt.

In the depicted embodiment, the rake tines (103) are designed to be removable and replaceable from the rake spine (104). As can be best seen in FIG. 3, in an embodiment, the rake spine (104) comprises a hollow tube with a generally quadrilateral cross section. The tines (103) are inserted from above through holes in the spine (104) and are then secured with a clamping or screw mechanism from above. Thus, should a tine (103) become damaged (e.g. bent or broken) it can be removed from the spine (104) and replaced with a new tine (103). Further, in an alternative embodiment, this allows for the rake (102) to utilize a variety of tines (103) of different lengths for different jobs.

The rake attachment (102) of the mechanized asphalt comb (101) is attached to an engineering vehicle (105). The term "engineering vehicle," as used herein, shall include any engineering vehicle or heavy equipment machine known to those of ordinary skill in the art, now or in the future, that is capable of moving or transporting materials. Examples of contemplated engineering vehicles (105) include, but are not limited to, skid loaders, steammollers, tractors, compact excavators, backhoe loaders, bulldozers, excavators, forklift trucks, loaders, and heavy-duty trucks. In a preferred embodiment, the engineering vehicle (105) will have one or more lift arms to which the rake attachment will be attached, although this is not determinative. For example, in the embodiment in which the mechanized asphalt comb (101) is attached to a steammoller it would be attached in a manner to the rolling apparatus.

The form of attachment of the rake attachment (102) to the engineering vehicle (105) is not determinative. For example, the rake attachment (102) may be bolted, screwed, clipped, slotted or attached in another manner known to those of ordinary skill in the art to the engineering vehicle (105). Further, permanent, semi-permanent and temporary forms of attachment of the rake attachment (102) to the engineering vehicle (105) are contemplated. In the embodiments where the engineering vehicle (105) has one or more lift arms, it is contemplated that the rake attachment (102) will be attached to these component parts of the engineering vehicle (105).

In certain embodiments it is contemplated that the rake attachment (102) of the asphalt comb (101) will be attached directly to the engineering vehicle (105) or a lift arm or lift arms thereof. In other embodiments, as depicted in FIGS. 2-6, it is contemplated that the mechanized asphalt comb (101) will further comprise an arm (109). The function of the arm (109) of the mechanized asphalt comb (101) is to both connect and create a certain distance between the rake attachment (102) and the engineering vehicle (105) to allow for visualization of the raking activity by the vehicle operator and/or to limit the need for the vehicle (105) to enter the repair area or drive around the repair and rake from both sides. Thus, on one end the arm (109) will be attached to an engineering vehicle (105) and on the opposite terminating end the arm (109) will be attached to the rake attachment (102). Another function of the arm (109) of the mechanized asphalt comb (101) is to create a loading support area for an individual to stand on while loading hot mix asphalt from an asphalt storage tank into the dumping container (106) of the mechanized asphalt comb (101). Similar to the rake attachment (102), it is contemplated that the arm (109) may be comprised of steel or other heavy metal material known to those of ordinary skill in the art. Further, the dimensions of the arm (109) are not determinative. The arm (109) may be any length, width or shape to correspond with and link via attachment the rake attachment (102) and the engineering vehicle (105), and in embodiments where the arm (109) has a loading support area, to provide a platform for a laborer to stand and work from. In the embodiment of an arm with a loading support area, it is also contemplated the arm will have side rail supports, as shown in FIGS. 2-4, for added stability.

In the embodiments of the mechanized asphalt comb (101) in which the mechanized asphalt comb (101) is attached to a lift arm or lift arms of the engineering vehicle (105) (either directly or via an arm (109)) it is contemplated that the mechanized asphalt comb (101) will have a raised inactive (107) position (depicted in FIG. 6) and lowered active (108) position (depicted in FIGS. 2-4). As demonstrated in FIG. 6, in the raised inactive position (107), the mechanized asphalt comb (101) is raised at a certain angle above the ground or asphalt pavement. This position allows the engineering vehicle (105) to move around freely without any risk of the mechanized asphalt comb (101) coming into contact with the ground and hampering the engineering vehicle's (105) mobility. Further, as demonstrated in FIGS. 2-4, in the lowered active position (108) the mechanized asphalt comb (101) is lowered to a position in which it can engage with, rake, and scarify a given asphalt repair area. It is contemplated that in the embodiment of the mechanized asphalt comb (101) in which the comb (101) is attached to the lift arm(s) of an engineering vehicle (105) that the operator of the engineering vehicle (105) will be able to position the mechanized asphalt comb (101) in the inactive raised position (107) and the active lowered position (108), along with a variety of positions in the range in between.

Another contemplated component of the asphalt comb (101) is the dumping container (106). Embodiments of the asphalt comb (101) that contain a dumping container (106) are depicted in FIGS. 2-6. As shown therein, the dumping container (106) is a receptacle for a certain volume of material. The dimensions and shape of the dumping container (106) of the asphalt comb (101) are not determinative; the dumping container (106) may take on any shape or dimensions that allow it to hold a given amount of hot asphalt therein when the asphalt comb (101) is in both its raised inactive (107) and lowered active (108) positions. In one embodiment, as depicted in FIGS. 2-4, it is contemplated that the dumping container 106) will have a slanted angle on the side of the dumping container (106) which faces the rake attachment (102), the angle facilitating both the loading of a mixture into and the dumping of a mixture from the dumping container (106). Further, the material that comprises the dumping container (106) is not determinative. Any material known to those of ordinary skill in the art that is capable of holding and retaining hot asphalt is contemplated. For example, in one embodiment, as depicted in FIGS. 2-6, the dumping container (106) will be comprised of steel or other heavy metal known to those of ordinary skill in the art.

Figure 5:
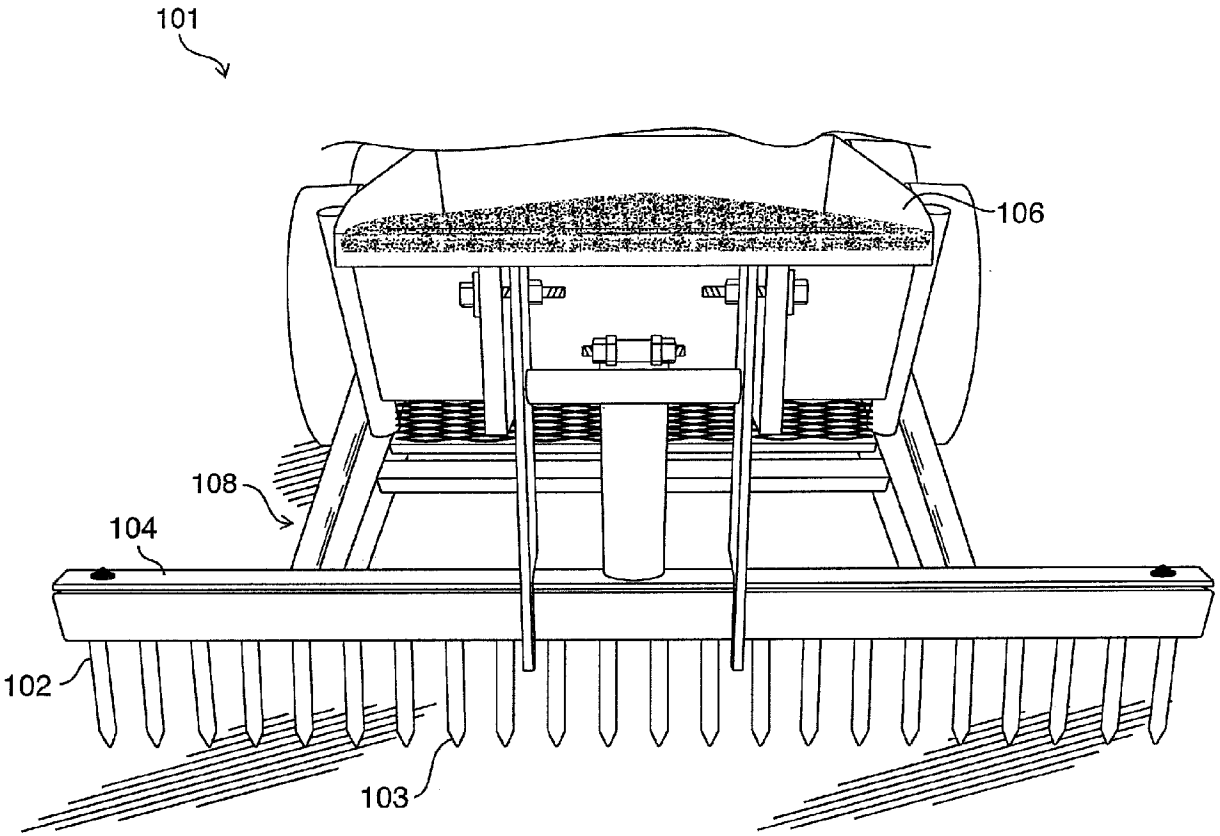
FIG. 5 provides a front perspective view of the asphalt comb.
Figure 6:
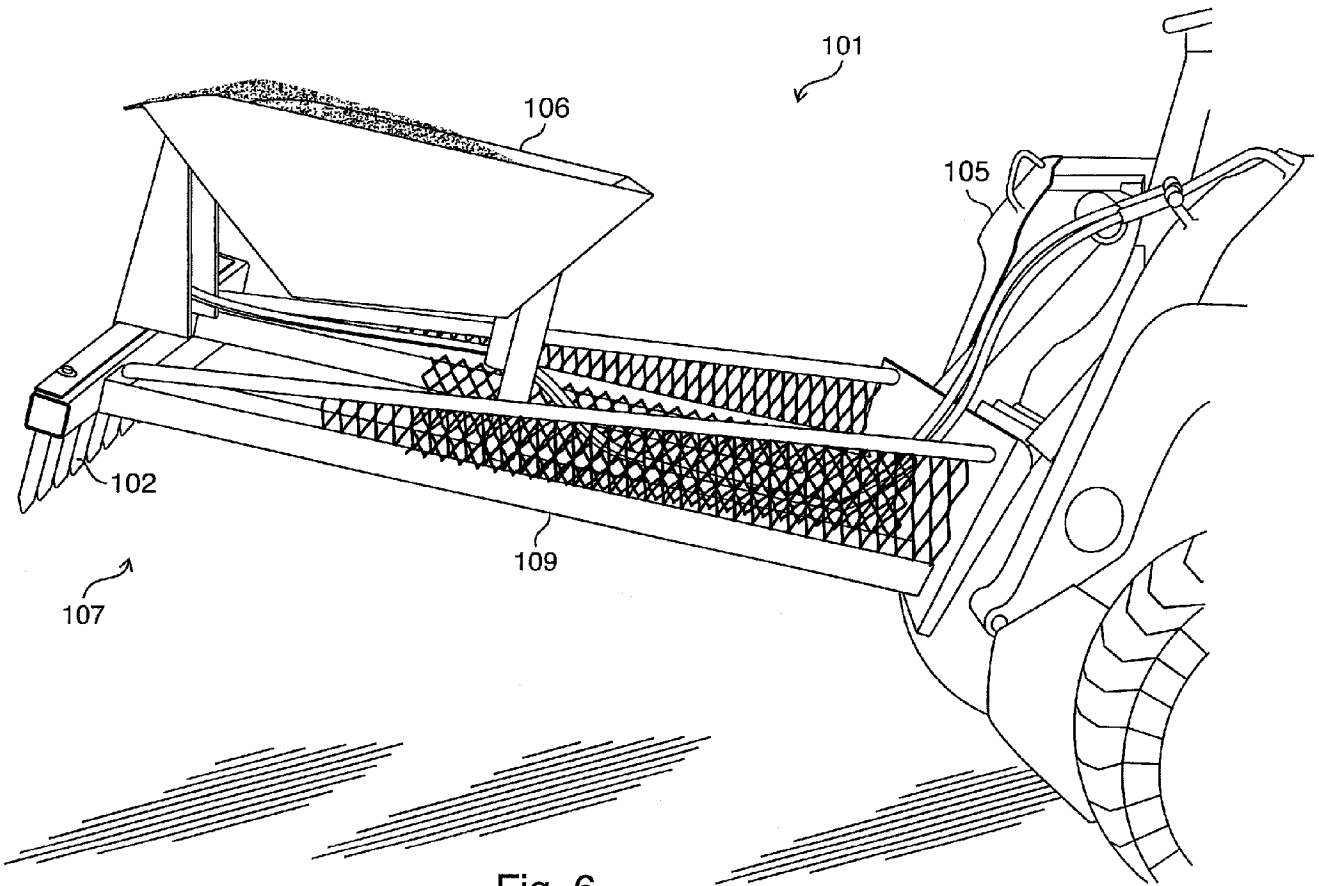
FIG. 6 provides a side perspective view of the asphalt comb in the inactive raised position.

In one preferred embodiment, it is contemplated that the dumping container (106) will be mechanically moveable around a hinge point on the front of the dumping container (106). An embodiment of this hinge point is depicted in FIG. 5. In this embodiment, an operator of the engineering vehicle (105) will be able to automatically raise and lower the dumping container (106) around the hinge point in order to dump the material contained therein onto the ground at a position generally in front of the rake attachment (102) of the asphalt comb (101). Once the material contained in the dumping container is distributed onto the ground in front of the rake attachment (102) of the asphalt comb (101), the dumping container (106) can be lowered to increase visibility for the device operator.

In one embodiment of the mechanized asphalt comb (101) in which the asphalt comb (101) is comprised of an arm (109), it is contemplated that the dumping container (106) will be located at a place generally close to the rake attachment (102) on the arm (109). It should be noted that the location of the dumping container (106) on the mechanized asphalt comb (101) is not determinative and any location on the rake attachment (102) and/or the arm (109) which allows for the dumping container (106) to freely move around its hinge point and distribute the material contained therein at a location generally in front of or behind the rake attachment (102) is contemplated. Similarly, in the embodiments of the mechanized asphalt comb (101) in which the mechanized asphalt comb (101) is directly attached to the engineering vehicle (105) it is contemplated that the dumping container (106) will be attached either the rake attachment (102) or the engineering vehicle in such a manner that the asphalt or other material contained therein can be easily transported and, if desired, dumped into a position on the ground generally in front of the rake attachment (102). This allows for the material to be dumped in very close time proximity to the initial agitation by the rake which eliminates the need for a worker to go and get the wheelbarrow of material and then dump it. Further, dumping of the material in proximity to the rate (102) makes it easier for the rake (103) to be used to agitate the new material with the old which can create a more dispersed and uniform blend of old and new asphalt. Improved distribution in the mix will often provide a patch with increased strength and stability.

In alternative embodiments, it is contemplated that the asphalt comb (101) will further comprise a heating element known to those of ordinary skill in the art. Contemplated heating elements include, but are not limited to, infrared, gaseous and electrical modalities. In these embodiments, it is contemplated that the heating element, when activated, will heat the rake attachment (102) such that the rake attachment (102) increases the overall temperature of the asphalt it comes into contact with and rakes. In one embodiment, it is contemplated that the mechanized asphalt comb will further comprise an infrared heating panel.

Further, in additional alternative embodiments it is contemplated that the asphalt comb (101) will also comprise a cooling element known to those of ordinary skill in the art. Contemplated cooling elements include, but are not limited to, devices that use air and or water to lower the temperature of an exposed material. In these embodiments, it is contemplated that the cooling element will be located at a place on the asphalt comb (101) such that, when engaged, it can be applied to the recently repaired asphalt repair area. For example, in one embodiment it is contemplated that the cooling element will be located on the bottom of the arm (109) of the asphalt comb (101) behind the rake attachment (102) (i.e., closer to the engineering vehicle (105)).

In yet another alternative embodiment, it is contemplated that the mechanized asphalt comb will also comprise a compression mechanism, such as a roller or vibratory compressor, known to those of ordinary skill in the art. In these embodiments, the roller will be utilized to compress the newly laid hot asphalt mix after it has been deposited and leveled onto the asphalt repair area.

Figure 7:
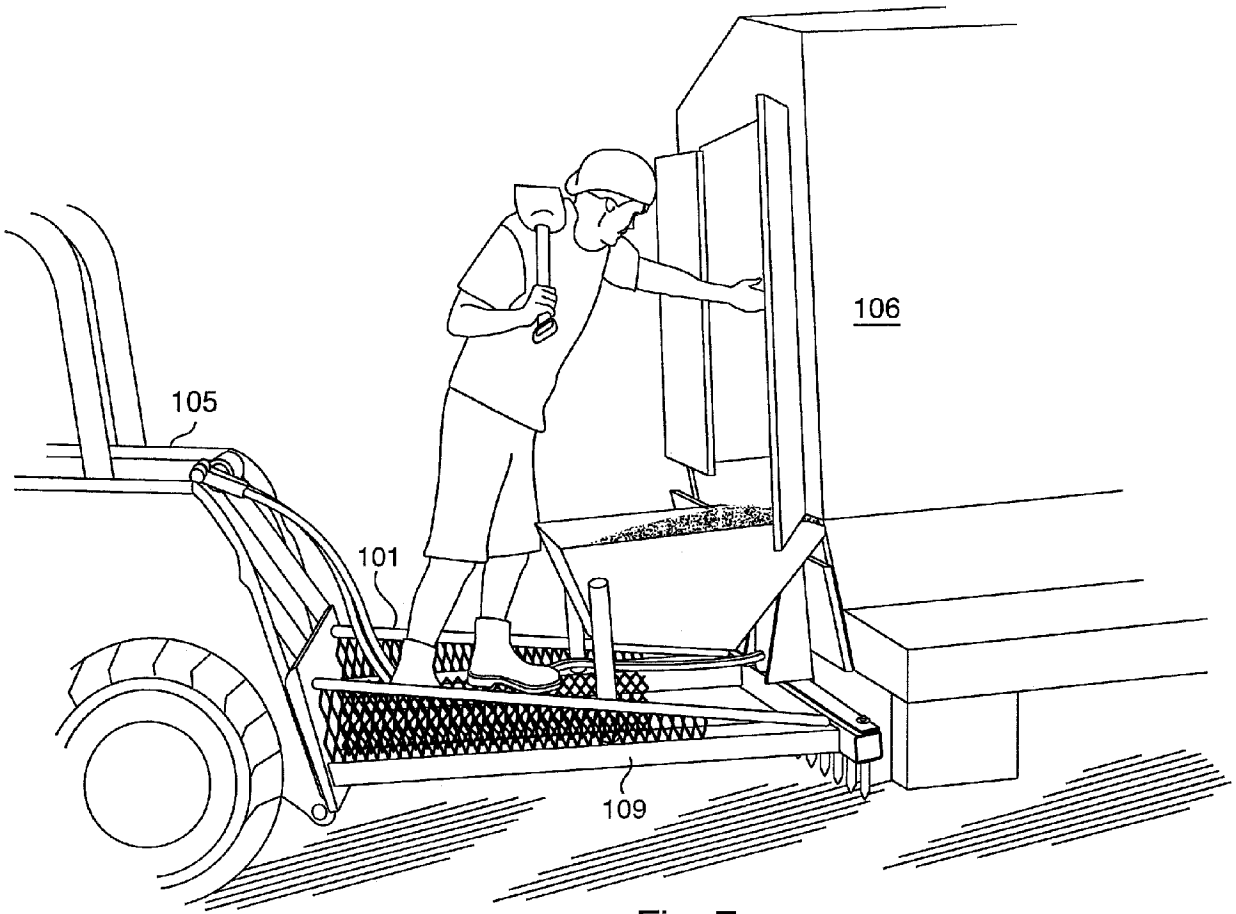
FIG. 7 provides a perspective view of the asphalt comb in a loading position next to a hot asphalt mix storage container.

In use, the mechanized asphalt comb (101) provides a mechanized method for removing the top layer of an asphalt repair area, raking and scarifying an asphalt repair area, and applying new material to an asphalt repair area—steps which, under the traditional infrared asphalt repair methodology, were performed manually. For example, in one embodiment, the asphalt comb (101) disclosed herein is utilized as follows. First, a portion of asphalt repair material is loaded into the dumping container. In the embodiment of the mechanized asphalt comb (101) with an arm (109) with a loading support area, this step of loading can be taken by lowering the mechanized asphalt comb (101) into its lowered active position (108) and moving the mechanized asphalt comb (101) into a position where the edge of the dumping container (106) located closer to the rake attachment (102) is at or generally near the storage container for the hot asphalt. This orientation of the mechanized asphalt comb (101) and a storage container while hot asphalt mix is being loaded into the dumping container (106) is depicted in FIG. 7. Then a laborer steps up on the loading support area of the arm and, from this position, is able to easily shovel the hot mix asphalt from the storage container into the dumping container (106). Once loaded, the laborer removes himself or herself from the arm and the mechanized asphalt comb (101) is placed in the raised inactive position (107) so the engineering vehicle (105) can move freely.

Second, while the mechanized asphalt comb (101) is in the raised inactive position (107), the engineering vehicle (105) is driven to an asphalt repair site (i.e., an area of asphalt that has been heated or will be heated by an infrared panel or other methodology known to those of ordinary skill in the art.).

Then, in a third step, the mechanized asphalt comb (101) is lowered into the active lowered position (108) at the asphalt repair site and, while in the active lowered position, the engineering vehicle (105) is manipulated forwards and backwards in a manner to rake and scarify the asphalt located at the repair site with the rake attachment (102). In this step, the mechanized asphalt comb (101) will generally be maintained at the same angle for each pass on the repair area, however an operator may change the angle if a deeper or shallower scarifying depth is desired. Further, it is contemplated that, in certain instances, only one pass will be needed to sufficiently scarify and agitate the repair area. A pass generally includes lowering the asphalt comb (101) into an asphalt repair area and either reversing the engineering vehicle (105) or putting the engineering vehicle (105) in drive such that the entire asphalt repair area is agitated and raked by the rake attachment (102) in one pass. In certain embodiments, it is preferred that the scarification occur to a depth of about two (2) to four (4) inches to provide for a deep repair.

This step of the mechanized asphalt comb (101) process has numerous advantages over the manual raking processes of the prior art. For example, a desired depth and agitation can be maintained throughout a given repair area and can be greater than can be accomplished manually. Further, since the agitation and scarification are accomplished by moving a mechanized asphalt comb (101) equipped engineering vehicle (105) back-and-forth, the time and laborer fatigue associated with the manual processes are eliminated. In addition, contrary to the manual method which inherently requires multiple raking actions and passes, the mechanized asphalt comb (101) is capable of sufficiently agitating and scarifying a repair area in one or two passes.

Figure 8:
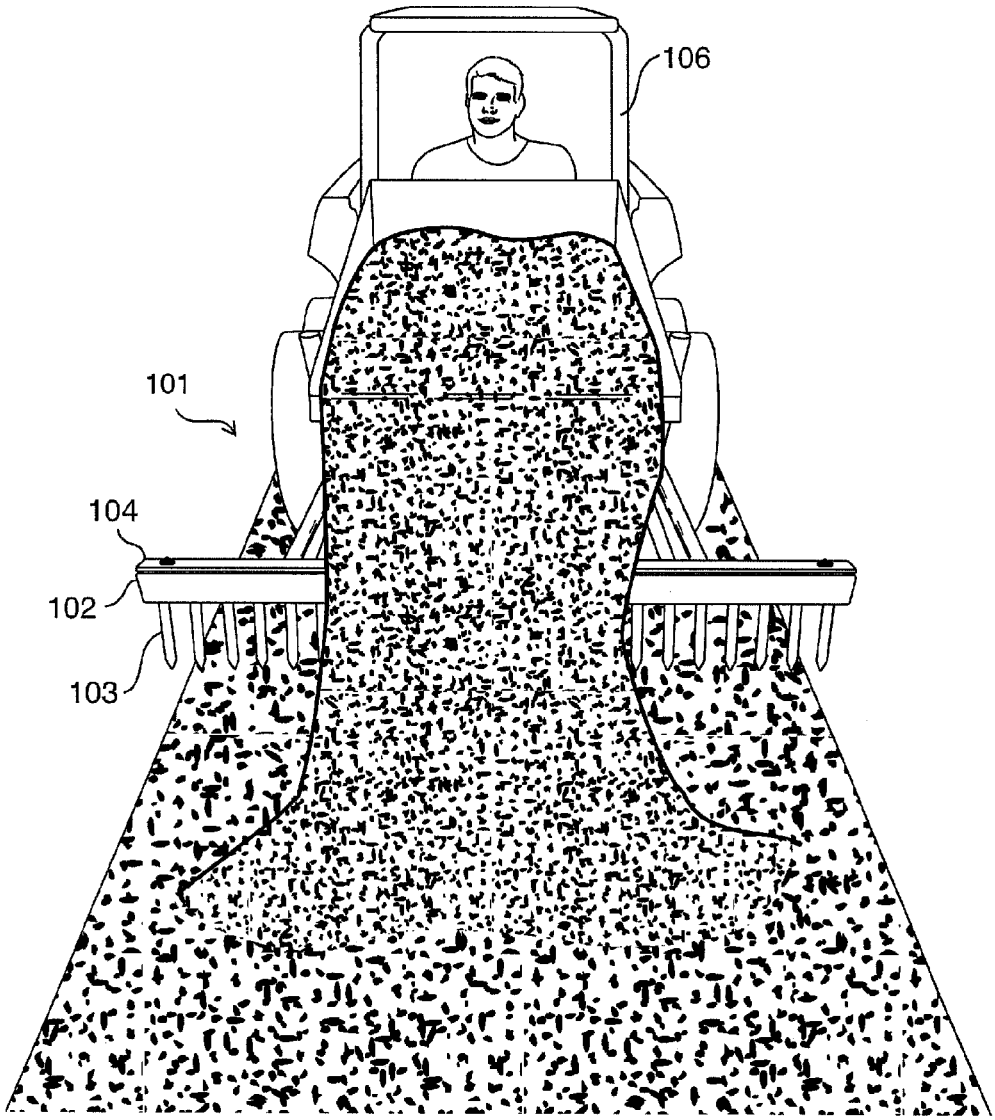
FIG. 8 provides a perspective view of the asphalt comb in a dumping position over an asphalt repair area.

Once the raking and scarification is completed, the mechanized asphalt comb (101) is raised into the raised inactive position (107). Then, in a fourth step, the asphalt repair material loaded into the dumping container (106) is dumped onto the repair site in front of the rake attachment (102) of the mechanized asphalt comb (101). In one embodiment, this dumping step will take place as follows. First, the mechanized asphalt comb (101) will be maneuvered into a position generally above the repair area and the mechanized asphalt comb (101) will be lowered to a position generally parallel to the repair area. This orientation of the mechanized asphalt comb in the dumping step is depicted in FIG. 8. Once in this position, the dumping container (106) will be raised via its hinged attachment to an angle at which the hot asphalt mix contained therein will begin to be deposited onto the repair area. Next, while the dumping container (106) is in the raised position, the engineering vehicle (105) will be manipulated forwards and backwards in a manner that will allow for generally all of the hot asphalt mixture contained in the dumping container (106) to be dumped onto the repair area. Alternatively, the mixture may be dumped in batches to provide extra mixture at particular points.

After the dumping is complete, in a final step, the dumping container (106) is lowered from the raised position and the mechanized asphalt comb (101) is lowered into the lowered active position (109). Once lowered, the engineering vehicle is manipulated forwards and backwards in a manner to distribute the hot mix asphalt material within in the repair area. It is also contemplated that the mechanized asphalt comb (101) will be used to lute the repair area; i.e., the hot asphalt mix in the repair area is leveled with the surrounding asphalt by having a luting attachment thereon which can swing won below the tines (103). After luting, the repair area will be compressed and allowed to cool. Alternatively, the luting process may still be performed by hand. In the embodiments in which the mechanized asphalt comb (101) comprises a cooling mechanism and a compressor, it is contemplated that these steps may be performed by the mechanized asphalt comb (101).

In sum, the mechanized asphalt comb (101) described herein has numerous advantages over the manual raking process previously utilized in the art of infrared asphalt repairs. Utilizing this method, time is saved and the efficiency of the repair process is increased since an operator can rake a newly heated repair area in as little as one pass. Further, this method and device allows an operator to rake the patch deeper and at a consistent depth throughout the repair area compared to the known manual methodologies. This improvement is feasible because, among other things, the rake attachment generally corresponds in width to the repair area, is heavily constructed, and is attached to a piece of machinery that can provide a consistent downward pressure; i.e., it is not subject to fatigue like laborers in the manual raking process of the prior art.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. A mechanized asphalt comb, the comb comprising:

a rake attachment, the rake attachment being comprised of a rake spine and a plurality of teeth distributed along the rake spine in a downward orientation; and an arm, the arm being comprised of two opposing terminating ends, the rake attachment being attached to one of the arm's terminating ends;

wherein the asphalt comb is attached to an engineering vehicle via the terminating end of the arm opposite the rake attachment such that the engineering vehicle can control and manipulate the asphalt comb into a raised inactive position, a lowered active position, and a plurality of positions between the raised inactive position and the lowered active position; and wherein, when in the lowered active position, the asphalt comb applies a fixed downward pressure and depth of penetration to a surface.

2. The mechanized asphalt comb of claim 1, wherein the rake attachment is approximately 6 feet long.

3. The mechanized asphalt comb of claim 1 further comprising a dumping container, the dumping container being hingedly attached to the asphalt comb.

4. The mechanized asphalt comb of claim 1 further comprising a cooling element, the cooling element being attached to the arm in a downward orientation.

5. The mechanized asphalt comb of claim 1 further comprising a heating element, wherein the heating element raises the temperature of the rake attachment to a desired level.

6. The mechanized asphalt comb of claim 1 wherein said plurality of teeth is removable from said rake spine.

7. The mechanized asphalt comb of claim 6 wherein each of said teeth in said plurality of teeth is individually removable from said rake spine.

8. A mechanized method for removing and applying asphalt during an asphalt repair, the method comprising:

obtaining a mechanized asphalt comb attached to an engineering vehicle, the asphalt comb comprising:

a rake attachment, the rake attachment being comprised of a rake spine and a plurality of teeth distributed along the rake spine in a downward orientation;

an arm, the arm being comprised of two opposing terminating ends, the rake attachment being attached to one of the arm's terminating ends; and wherein the asphalt comb is attached to an engineering vehicle via the terminating end of the arm opposite the rake attachment such that the engineering vehicle can control and manipulate the asphalt comb into a raised inactive position, a lowered active position, and a plurality of positions between the raised inactive position and the lowered active position; and wherein, when in the lowered active position, the asphalt comb applies a fixed downward pressure and depth of penetration to a surface;

moving the engineering vehicle to an asphalt repair site;

positioning the asphalt comb in a lowered active position; and scarifying the asphalt repair site while the asphalt comb is in the lowered active position.

9. The mechanized method for removing and applying asphalt during an asphalt repair of claim 8, the method further comprising:

in said step of obtaining, obtaining a mechanized asphalt comb further comprising:

a dumping container, the dumping container being hingedly attached to the asphalt comb;

after said step of obtaining, loading asphalt repair material into the dumping container;

after said step of scarifying, dumping the asphalt repair material in the dumping container onto the asphalt repair site; and distributing the asphalt repair material.

* * * * *